US005114336A

United States Patent [19]

Karabin et al.

[11] Patent Number: 5,114,336

[45] Date of Patent: May 19, 1992

[54] METHOD AND APPARATUS FOR PRODUCING A YELLOW FLAME WITHIN A FIREPLACE

[75] Inventors: Tadeusz Karabin, Huntington; Roy E. Mundy, Roann, both of Ind.

[73] Assignee: Majco Building Specialties, L.P., Huntington, Ind.

[21] Appl. No.: 551,504

[22] Filed: Jul. 11, 1990

[51] Int. Cl.[5] ..... F23Q 2/32

[52] U.S. Cl. ..... 431/125; 126/512; 126/500; 431/2; 431/12

[58] Field of Search ..... 431/125, 2, 12; 126/92 R, 116 R, 112, 500, 512, 515

[56] References Cited

U.S. PATENT DOCUMENTS 2,084,566 6/1937 Warfield .
3,760,790 9/1973 Voges et al. .
3,947,229 3/1976 Richter .
4,259,941 4/1981 Gerdes ..... 126/515
4,573,907 3/1986 Coppin et al. .
4,838,240 6/1989 Rieger .
4,838,241 6/1989 Rieger .
4,976,253 12/1990 Beal et al. ..... 126/512

*Primary Examiner*—Larry Jones
*Attorney, Agent, or Firm*—Hoffmann & Baron

[57] ABSTRACT

A fireplace gas burning assembly for producing a clean burning yellow flame in a chamber is disclosed. The assembly includes at least one means for introducing a substantially vertical flow of a flammable fluid into the chamber. The assembly also includes at least one means for introducing a substantially vertical stream of secondary air into the chamber. The means for introducing a substantially vertical stream of secondary air into the chamber is positioned such that the stream of air and flow of flammable fluid intersect such that when ignition occurs a yellow clean burning flame will be produced.

34 Claims, 3 Drawing Sheets

METHOD AND APPARATUS FOR PRODUCING A YELLOW FLAME WITHIN A FIREPLACE

BACKGROUND OF THE INVENTION

The present invention relates to gas burners, and, in particular, it embraces the intermixing or "intersection", within a fire chamber, of a substantially vertical flow of flammable fluid with a substantially vertical stream of secondary air to produce an aesthetically appealing yellow flame which burns efficiently and cleanly.

Gas fireplaces are rapidly replacing wood burning fireplaces. In general, they are easier to clean, easier to maintain and cleaner burning than conventional wood burning fireplaces. Commonly, "primary air" is introduced into a gas-air mixing chamber so as to achieve more complete combustion. However, this requires the use of a mixing chamber which adds to the cost and complexity of the unit. A common drawback of gas fireplaces is that they have difficulty in producing a flame which resembles that of a natural wood log fire. Further, those gas fireplaces which have been able to produce a yellow flame produce high amounts of carbon monoxide and other undesirable pollutants.

U.S. Pat. No. 4,838,240, and U.S. Pat. No. 4,838,241, both to Rieger, disclose a burner assembly for use in a fireplace. The burner assembly produces a flame pattern which resembles that of a natural wood log fire and has a reduced level of carbon monoxide production. The flame is yellow. Gas enters the burner assembly through an orifice and mixes with a predetermined amount of fresh air in a mixing chamber. The mixture of gas and air is transferred to an opening to be lighted. A problem with Rieger is that it requires a mixing chamber which adds to the cost and expense of manufacture.

U.S. Pat. No. 3,947,229 to Richter discloses an artificial fireplace having a burner and simulated logs. The burner includes a chamber for the mixing of gas and air. The mixture of gas and air passes through a myriad of tiny passageways and is then ignited. A problem with Richter is that it requires both a mixing chamber and a myriad of passageways for the gas-air mixture. This adds to the complexity and cost of the unit.

U.S. Pat. No. 2,084,566 to Warfield discloses a gas fireplace log. The log is hollow and receives a mixture of gas and air through a mixing tube. The mixing tube receives air from an inlet aperture and gas from a gas line. The mixing tube leads to a burner within the hollow log. Burning occurs completely within the log. A drawback of Warfield is that it requires a mixing tube and a hollow log. Thus, the cost of manufacture is increased.

U.S. Pat. No. 3,760,790 to Voges et al. broadly discloses that it is known to mix secondary air with a gas at the base of a flame but does not disclose how this is done. A problem with Voges, however, is that the air is not introduced vertically into the root or base of the flame. Hence, the height of the flame may only be adjusted by varying the flow rate of the gas or varying the size of the gas orifice.

Accordingly, none of the related art describes a method and/or apparatus for producing a clean burning yellow flame involving the intersection, within a fire chamber, of a substantially vertical flow of flammable fluid with a substantially vertical flow of secondary air wherein the height of the flame may be varied by varying the rate of introduction of the vertical flow of secondary air.

It is therefore an object of the present invention to significantly reduce the amount of carbon monoxide and other pollutants produced by an aesthetically appealing yellow flame.

It is another object of the present invention to produce an aesthetically appealing, clean burning yellow flame without the use of mixing chambers and/or mixing tubes.

It is a further object of the present invention to vary the height of an aesthetically appealing clean burning yellow flame by varying the rate of introduction of secondary air and/or varying the rate of introduction of gas.

SUMMARY OF THE INVENTION

These and other objects of the present invention are achieved by the present invention which provides a fireplace gas burning assembly for producing a yellow clean burning flame in a chamber. The assembly includes ignition means and at least one means for introducing a substantially vertical flow of flammable fluid into the chamber. The assembly also includes means for introducing a substantially vertical stream of secondary air into the chamber. The means for introducing a substantially vertical stream of secondary air is positioned such that the stream of air and flow of flammable fluid intersect so as to form a clean burning yellow flame upon ignition.

Preferably, the assembly includes means for varying the rate of introduction of flammable fluid such as a gas valve. An air pump may be used to vary the rate of introduction of the stream of secondary air. Preferably, the air pump is a variable speed air pump.

Preferably, the assembly has at least one imitation log. The imitation log is in relationship to the intersecting stream and flammable fluid such that when the intersecting stream and flammable fluid burn, the imitation log appears to burn. The imitation log is supported by a grate.

The assembly is housed in a housing having a back wall, side walls and a base supporting the back wall and side walls. The base has at least one opening for the introduction of a substantially vertical stream of secondary air into a fire chamber. The base openings are positioned such that the substantially vertical stream of secondary air intersects the flow of flammable fluid so that when ignition occurs a clean burning yellow flame will be produced. Preferably, the opening in the base is circular in shape. The means for introducing flammable fluid can be a pipe having at least one aperture for the discharge of gas. Preferably, the housing has a front wall comprised of a transparent material such as glass.

The unit further includes a first air inlet located above the base of the housing and an opening above the first air inlet. Preferably, the first air inlet is of a size sufficient to provide about 20% of the secondary air to be introduced into the housing. A second air inlet is located beneath the base and serves to provide air to the means for providing a stream of air. Preferably, the second air inlet is of a size sufficient to introduce about 80% of the secondary air to be introduced into the assembly. The assembly includes a heat exchanger comprising an upper portion of the housing having a conduit extending therethrough. The conduit is constructed to receive air from the second air inlet and to discharge heated air through an air outlet. Preferably, the air outlet is located in the front wall. In a preferred embodiment an air pump is used to aid the flow of air.

In the method of producing the clean burning yellow flame of the present invention a substantially vertical flow of flammable fluid and a substantially vertical stream of secondary air are introduced into a fire chamber. The stream of secondary air is positioned such that it intersects the flow of flammable fluid. Ignition may occur prior to or after intersection of the flammable fluid with the secondary air. Suitably, the heat produced is used to heat air which is transferred to an area to be heated. Preferably, the secondary air is heated prior to ignition.

For a better understanding of the present invention, reference is made to the following description, taken in conjunction with the following figures, the scope of which is pointed out in the appended claims.

DETAILED DESCRIPTION OF THE INVENTION

Figure 1:
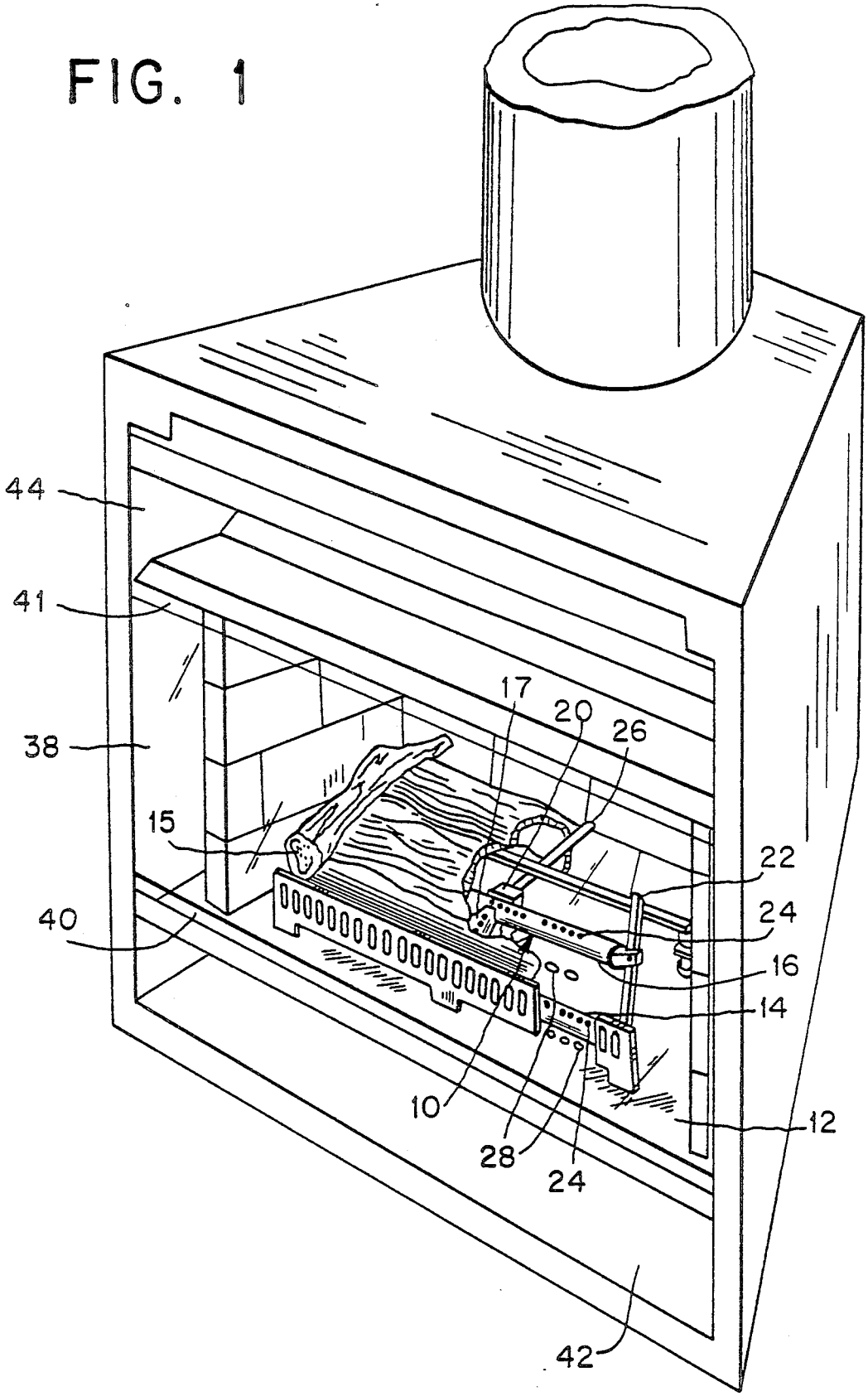
FIG. 1 is a top perspective view of the fireplace gas burner assembly and fireplace of the present invention.

A fireplace gas burner assembly 10 including a base plate 12, a front burner pipe 14, an imitation log 15, a rear burner pipe 16, and base plate secondary air openings 28 is provided. The fireplace gas burner assembly is capable of producing an aesthetically appealing yellow flame which burns efficiently and produces lower levels of pollutants than conventional yellow flame burners.

Figure 2:
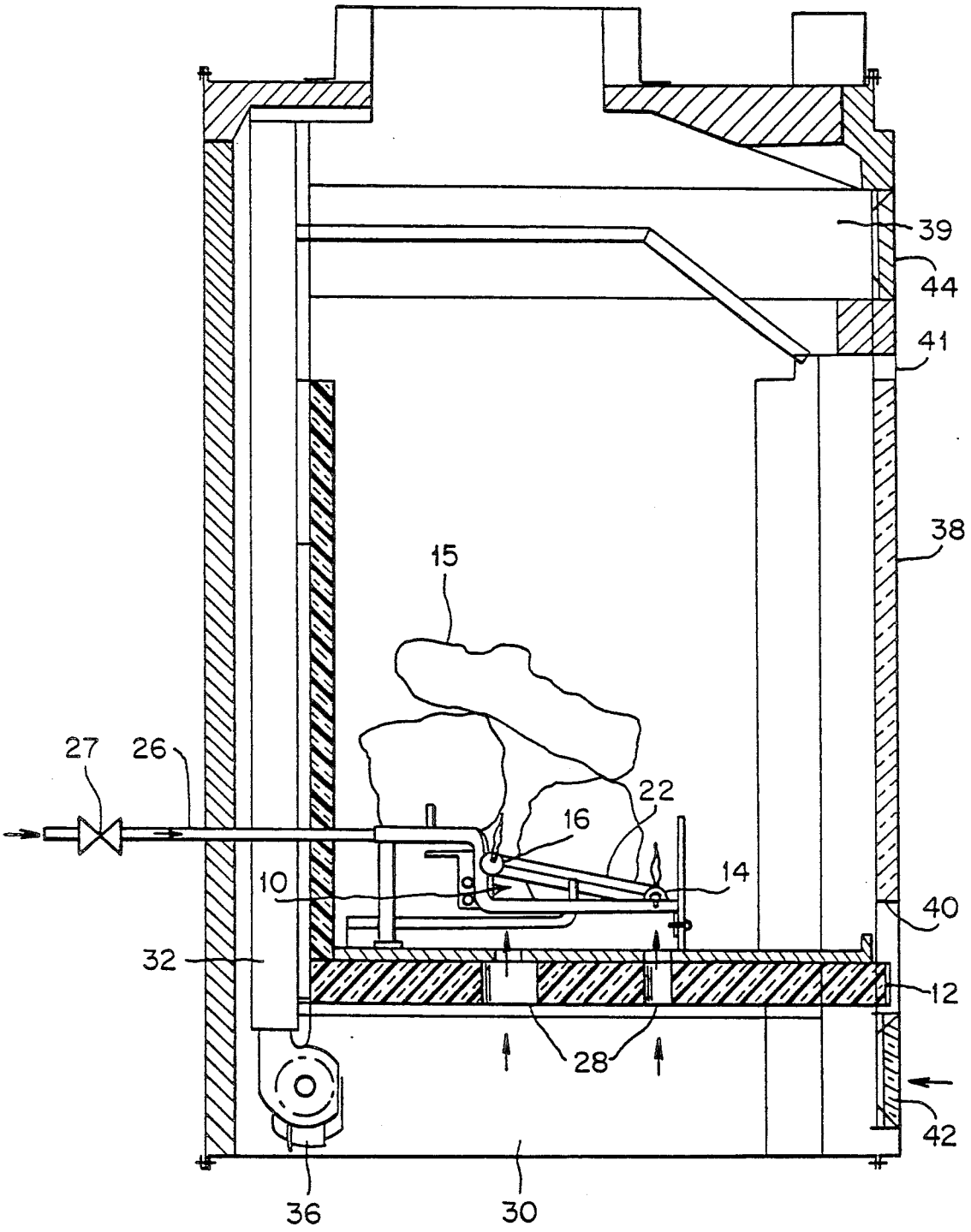
FIG. 2 is a cutaway view of the fireplace gas burner assembly and fireplace of the present invention.
Figure 3:
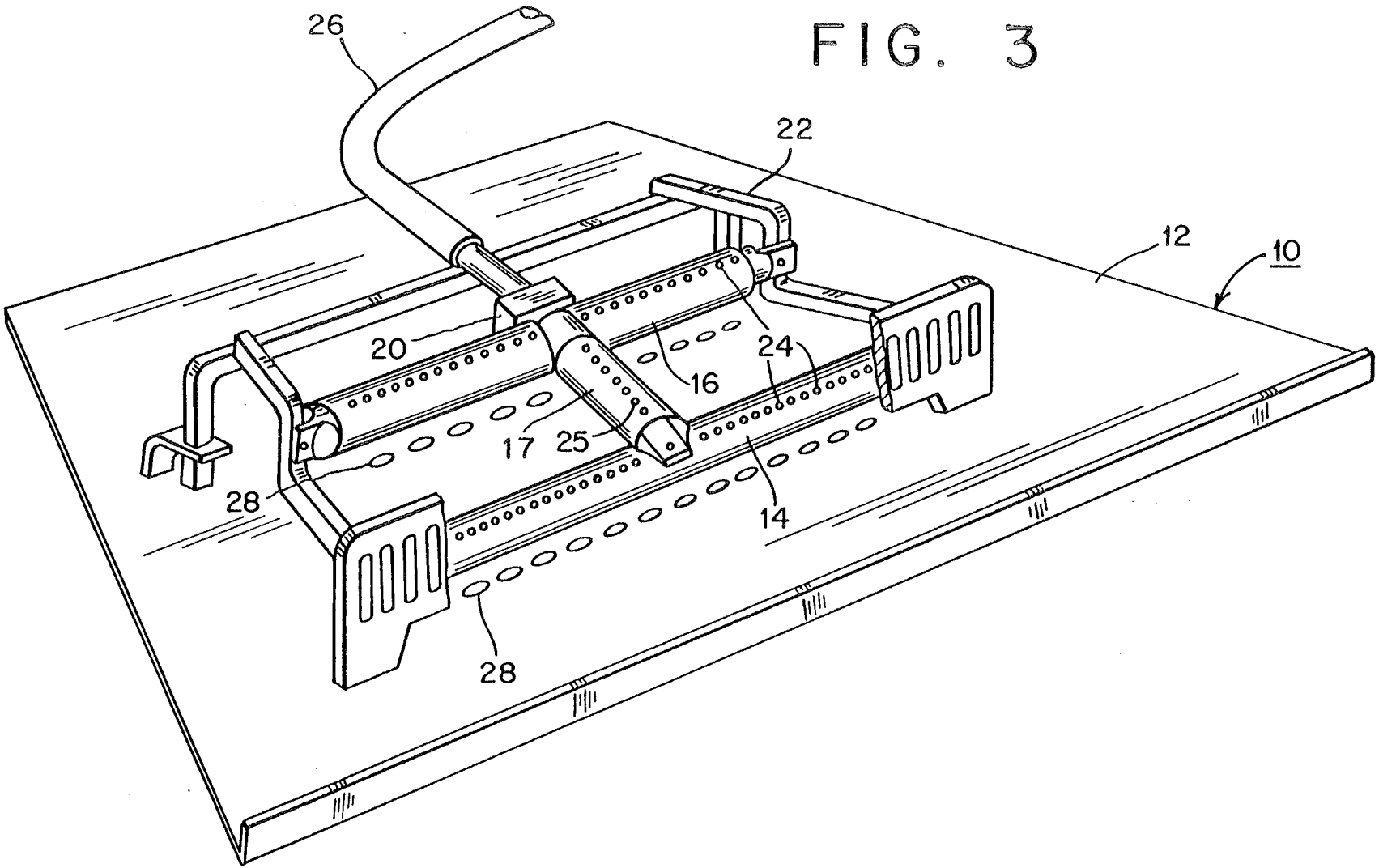
FIG. 3 is a top perspective view of the fireplace gas burner of the present invention.

Referring to FIGS. 1 and 2, the fireplace gas burner assembly includes a grate retainer assembly 22 to which front burner pipe 14, transverse burner pipe 17 and rear burner pipe 16 are mounted. Front burner pipe 14, transverse burner pipe 17 and rear burner pipe 16 have gas apertures 24 and 25. Gas is fed to the burner pipes by gas line 26. Gas exits gas apertures 24 in a substantially vertical direction. Secondary air is introduced substantially vertically to the base through secondary air openings 28. "Secondary air" refers to air which is not premixed with the gas and also to the air present in the combustion chamber. The base openings 28 are positioned such that the substantially vertical stream of secondary air intersects the flow of flammable fluid so that when ignition occurs a clean burning yellow flame will be produced. Preferably, the secondary air openings 28 are circular so as to provide a more uniform flow of air. Alternatively, the secondary air openings 28 may be slot-like in shape. The secondary air openings 28 are sized for the capacity of the burner. Preferably, the secondary air is heated prior to intersection with the flammable fluid. The gas and secondary air intersect in a substantially vertical manner. The rate of introduction of secondary air, and the flame size, may be varied by air pump 36.

An ignition means 20 is located in back of rear burner pipe 16, and provides heat from a pilot flame or a spark from a spark generator, to commence ignition of a flame which propagates towards the ends of rear burner pipe 16 and along transverse burner pipe 17, eventually igniting the gas or secondary air/gas mixture. The transverse burner pipe gas apertures 25 are intended primarily to aid in the travel of the flame to the front burner pipe 14.

A preferred embodiment includes a heat exchanger as illustrated in FIGS. 1 and 2. The heat exchanger comprises base conduit 30, back conduit 32 and upper conduit 34. Air pump 36 may be used to aid the flow of air through conduits 30, 32, 34 and air outlet 44. Preferably, air pump 36 is a variable speed air pump. Air is introduced to base conduit 39 through lower air inlet 42.

A preferred embodiment of the fireplace gas burner unit of the present invention includes a front wall 38. Preferably, the front wall 38 is made of a transparent material such as glass.

In operation gas is fed through gas line 26 and into rear burner pipe 16, transverse burner pipe 17 and burner pipe 14. The pressure in the burner pipe is from about 0.010 in. w.c. (inches water column) to about 0.040 in. w.c. The rate of introduction of the gas, and hence the flame size, may be varied by gas valve 27. Gas is evenly distributed through rear burner pipe 16, transverse burner pipe 17 and front burner pipe 14 as it passes through gas apertures 24 and 25. Preferably, the gas mixes with the air provided by an upper air inlet 40. The upper air inlet 40 allows ANSI fireplace heat standards to be met. Preferably, the upper air inlet 40 is of a size sufficient to introduce about 20 percent of the secondary air. A safety opening 41 is located above the upper air inlet 40. The safety opening 41 is designed to release flue gas from the unit should the flue become clogged or collapse. A lower air inlet 42 provides air to secondary air openings 28 located in base plate 12. Optionally, an air pump 36 may be used to increase the flow of air through lower air inlet 42.

As the gas leaves gas apertures 24, it is combined with a stream of secondary air from secondary air openings 28. The gas apertures 24 are arranged to discharge the gas in a substantially vertical manner. A substantially vertical stream of secondary air from air openings 28 intersects the stream of gas in a substantially vertical manner. The gas may be ignited, by ignition means 20, prior to or after intersection of the gas with the stream of secondary air. The flame propagates towards the ends of rear burner 16 and along transverse burner pipe 17, eventually igniting the gas or secondary air/gas mixture. The imitation logs 15 are positioned such that when the flame is ignited the imitation logs 15 appear to burn. Preferably, the flames do not impinge the logs as this will result in a cooler flame and less efficient burning. Logs which have a low coefficient of heat transfer will minimize this problem.

As the air enters the lower air inlet 42, it travels through base conduit 30. The air picks up heat from the base plate when combustion is occurring. The introduction of heated secondary air into the fire chamber through secondary air openings 28 is preferred and results in a cleaner burning flame. A portion of this air enters secondary air openings 28, the rest of the air travels through back conduit 32 and upper conduit 34. As the air travels through these conduits, it picks up heat from the burning gas and air mixture. The heated air travels through upper conduit 34 and is transferred to an area to be heated through hot air outlet 44.

Thus, while there have been described what are the presently contemplated preferred embodiments of the present invention, further changes and modifications may be made by those skilled in the art without departing from the scope of the invention, and it is contemplated to claim all such changes and modifications.

What is claimed is:

1. A fireplace gas burning assembly for producing a yellow clean burning flame, comprising:

a housing said housing including a base plate a chamber defined within said housing;

means for introducing a substantially vertical flow of flammable fluid to said chamber; and means for introducing a substantially vertical stream of secondary air to said chamber positioned so that the stream of secondary air and flow of flammable fluid intersect such that when ignition occurs a yellow clean burning flame will be produced, said means for introducing secondary air being positioned beneath said means for introducing flammable fluid said means for introducing secondary air including a plurality of openings in said base plate;

said assembly further including at least one imitation log positioned above the means for introducing the flammable fluid such that when said intersecting stream and flammable fluid burns, said imitation log appears to burn.

2. The fireplace gas burning assembly of claim 1 further comprising:

ignition means for igniting a flammable fluid within said chamber.

3. The fireplace gas burning assembly of claim 1 further comprising:

means for varying the rate of introduction of the flammable fluid.

4. The fireplace gas burning assembly of claim 3 wherein said means for varying the rate of introduction of the flammable fluid comprises a valve.

5. The fireplace gas burning assembly of claim 1 further comprising:

means for varying the rate of introduction of the stream of secondary air.

6. The fireplace gas burning assembly of claim 5 wherein said means for varying the rate of introduction of the stream of secondary air comprises an air pump.

7. The fireplace gas burning assembly of claim 6 wherein said air pump is a variable speed air pump.

8. The fireplace gas burning assembly of claim 1 further comprising:

a grate supporting said imitation log.

9. The fireplace gas burning assembly of claim 1 wherein said housing includes a back wall, side walls and a base supporting said walls.

10. The fireplace gas burning assembly of claim 9 wherein the means for introducing a substantially vertical stream of secondary air comprises at least one opening in the base.

11. The fireplace gas burning assembly of claim 10 wherein the opening is circular.

12. The fireplace gas burning assembly of claim 9 wherein said housing includes a front wall adjoining said side walls.

13. The fireplace gas burning assembly of claim 12 wherein said front wall is transparent.

14. The fireplace gas burning assembly of claim 12, wherein said front wall has a first air inlet above the base of the housing.

15. The fireplace gas burning assembly of claim 14, wherein said first air inlet is of a size sufficient to provide about 20 percent of secondary air to be introduced into the housing.

16. The fireplace gas burning assembly of claim 12, wherein said front wall has a safety opening above the first air inlet.

17. The fireplace gas burning assembly of claim 12, wherein said walls extend beneath the base and said front wall has a second air inlet located beneath the base, said second air inlet serving to provide air to said means for providing a stream of secondary air.

18. The fireplace gas burning assembly of claim 17, wherein said second air inlet is of a size sufficient to introduce about 80 percent of the secondary air to be introduced into the fireplace gas burning unit.

19. The fireplace gas burning assembly of claim 17, further comprising a heat exchanger, said heat exchanger comprising:

an upper portion of the housing, said upper portion having a conduit extending therethrough, said conduit constructed to receive air from said second air inlet and to discharge said air from an air outlet.

20. The fireplace gas burning assembly of claim 19, wherein said air outlet is located in the front wall.

21. The fireplace gas burning assembly of claim 1 wherein the means for introducing flammable fluid into said chamber include a pipe having a plurality of openings, said pipe being positioned within said chamber.

22. An assembly as described in claim 1 wherein said means for introducing a substantially vertical flow of flammable fluid includes a burner pipe, said burner pipe including a plurality of apertures for emitting gas in a substantially vertical direction, and means for supplying gas to said burner pipe.

23. An assembly as described in claim 22 including a chamber positioned beneath said burner pipe, said chamber including an upper wall including a plurality of apertures; means for introducing secondary air into said chamber; said apertures within the upper wall of said chamber being located beneath and oriented towards said burner pipe.

24. An assembly as described in claim 23 wherein said apertures within said burner pipe and said apertures in the upper wall of said chamber define a pair of substantially parallel rows.

25. An assembly as described in claim 24 including a second burner pipe including a row of apertures for emitting gas in a substantially vertical direction, said base plate including a row of apertures located beneath and oriented towards said second burner pipe.

26. An assembly as described in claim 22 where the upper wall of said chamber is a base plate, the assembly including a grate mounted to said base plate, said burner pipe being mounted to said grate.

27. A method of producing a clean burning yellow flame which comprises:

(a) providing a substantially vertical flow of flammable fluid to a fire chamber;

(b) providing a substantially vertical stream of secondary air to said fire chamber from beneath the level at which the flow of flammable fluid is provided to the fire chamber;

(c) causing said stream of secondary air to flow upwardly within the fire chamber such that it intersects said flow of flammable fluid;

(d) igniting said intersecting stream of secondary air and said flow of flammable fluid; and (e) controlling the rates at which the flammable fluid and secondary air are provided such that a visible yellow flame is produced.

28. The method of claim 27 including the step of heating the secondary air prior to providing it to the fire chamber.

29. The method of claim 27 further comprising:

introducing about 20% of the secondary air to be introduced into the fire chamber at a level above the level where the substantially vertical stream of secondary air is introduced into the fire chamber.

30. A method as described in claim 27 wherein said flammable fluid is a gas, comprising the steps of providing a burner pipe having a plurality of upwardly oriented apertures within the fire changer, causing the gas to flow within the burner tube such that the gas is emitted by the apertures in a substantially vertical direction, providing a reservoir including a plurality of upwardly oriented apertures beneath said burner pipe, and introducing the secondary air to said chamber such that the second air is emitted by the apertures in said reservoir in a substantially vertical direction towards said burner pipe.

31. A method as described in claim 30 including the step of introducing a second stream of secondary air above the level in said fire chamber that secondary air is introduced by the apertures in said reservoir, the apertures in said reservoir providing a greater amount of secondary air to the fire chamber per unit of time than said second stream of secondary air.

32. A method of producing a clean burning yellow flame which comprises:

(a) providing a substantially vertical flow of flammable fluid to a fire chamber;

(b) igniting said flammable fluid;

(c) providing a substantially vertical first stream of secondary air to said fire chamber;

(d) causing said substantially vertical first stream of secondary air to flow such that it intersects said flow of flammable fluid; and (e) introducing a second stream of secondary air into said fire chamber above the level at which the first stream of secondary air is introduced into said first chamber, said second stream of secondary air providing about twenty percent of the total secondary air introduced into said fire chamber, 33. The method of claim 32 wherein the secondary air is heated prior to being provided into the fire chamber.

34. The method of claim 32 further comprising:

introducing the substantially first vertical stream of second air at a level below the level of introduction of the substantially vertical flow of flammable fluid.

* * * * *

UNITED STATES PATENT AND TRADEMARK OFFICE

CERTIFICATE OF CORRECTION

PATENT NO. : 5,114,336

DATED : May 19, 1992

INVENTOR(S) : Tadeusz Karabin and Roy E. Mundy

It is certified that error appears in the above-identified patent and that said Letters Patent is hereby corrected as shown below:

At Column 7, line 19, before "air", delete "second" and insert --secondary--;

At Column 8, lines 15, after "said", delete "first" and insert --fire--.

Signed and Sealed this

Seventeenth Day of August, 1993

Bruce Lehman

*Attest:*

BRUCE LEHMAN

*Attesting Officer*

*Commissioner of Patents and Trademarks*